United States Patent [19]

Glavas et al.

[11] 4,354,645

[45] Oct. 19, 1982

[54] COLLAPSIBLE MANDREL FOR PRECISE WINDING OF A COIL

[75] Inventors: Xenophon G. Glavas; Robert E. Thompson, both of Roanoke, Va.

[73] Assignee: International Telephone and Telegraph Corporation, New York, N.Y.

[21] Appl. No.: 161,949

[22] Filed: Jun. 23, 1980

[51] Int. Cl.[3] ..... B65H 75/18

[52] U.S. Cl. ..... 242/117

[58] Field of Search ..... 242/115, 116, 117, 118.4, 242/78.1, 82

[56] References Cited

U.S. PATENT DOCUMENTS

| | | | |
|---|---|---|---|
| 1,984,604 | 12/1934 | Stahl | 242/117 X |
| 2,204,938 | 6/1940 | Le Bus | 242/117 |
| 2,628,814 | 2/1953 | Spalding | 242/117 X |
| 2,732,150 | 1/1956 | Le Bus | 242/117 |
| 2,892,598 | 6/1959 | Dudley | 242/117 |
| 3,266,748 | 8/1966 | Le Bus | 242/117 |

*Primary Examiner*—Edward J. McCarthy

*Attorney, Agent, or Firm*—John T. O'Halloran; Alfred C. Hill

[57] ABSTRACT

Th collapsible mandrel includes a core upon which the coil is wound removably secured to a pair of spaced parallel flanges. The core includes a pair of hollow, partially semicircular members each having an arc length less than 180° and a pair of transition members each disposed to fill a different one of two spaced gaps between the pair of hollow members. Each of the hollow members has a plurality of spaced grooves on the outer surface thereof substantially parallel to the pair of flanges to receive the material which is to be wound to provide the coil. A shaft is disposed coaxially of the axis of the core extending between the pair of flanges internally of the core. The shaft includes an arrangement to releasably lock the core and the pair of flanges into an integral unit when the coil is being wound. Upon completion of the winding of the coil, the shaft and the pair of flanges are unlocked and removed. Then the pair of transition members are removed and the pair of hollow members are moved toward each other and removed from the formed coil.

30 Claims, 4 Drawing Figures

COLLAPSIBLE MANDREL FOR PRECISE WINDING OF A COIL

BACKGROUND OF THE INVENTION

This invention relates to the field of coil winding and, more particularly to a mandrel enabling the winding of a precision coil from material having a circular cross-section.

Previously coils have been wound from material having a circular cross-section employing a solid mandrel, or a coil winding arbor. Employing these devices, the precision winding of a material of circular cross-section cannot be maintained in coil manufacture.

SUMMARY OF THE INVENTION

An object of the present invention is to provide a collapsible mandrel enabling the precise winding of a material having a circular cross-section into a precision-wound coil.

A feature of the present invention is the provision of a collapsible mandrel for precise winding of a material having a circular cross-section into a precision-wound coil comprising a pair of spaced parallel flanges; a core upon which the coil is wound disposed between the pair of flanges perpendicular thereto, coaxial of a longitudinal axis and removably secured to the pair of flanges, the core including a pair of hollow, partially semicircular members extending between the pair of flanges, each of the hollow members having a given arc length less than 180°, being disposed on a different side of the axis and having an outer surface containing therein a plurality of spaced grooves substantially parallel to the pair of flanges, each of the plurality of grooves having a radius substantially equal to the radius of the material, and a pair of grooveless transition members extending between the pair of flanges, each of the transition members being disposed on a different side of the axis between adjacent ends of the pair of hollow members and having a selected arc length equal to the difference between 180° and the given arc length; and a shaft disposed coaxial of the axis extending between the pair of flanges internally of the core, the shaft having a thread on one end thereof extending beyond one of the pair of flanges to receive a nut to releasably lock the core and the pair of flanges into an integral unit when the coil is being wound and to enable removal of the nut, the pair of flanges and the pair of transition members to permit removal of the pair of hollow members after the coil has been wound.

The material having a circular cross-section as referred to herein has reference to a single strand of metallic conductor, a cable formed from a plurality of such conductors, an optical fiber and an optical cable formed from a plurality of such optical fibers.

BRIEF DESCRIPTION OF THE DRAWING

Above-mentioned and other features and objects of this invention will become more apparent by reference to the following description taken in conjunction with the accompanying drawing, in which.

DESCRIPTION OF THE PREFERRED EMBODIMENT

Figure 1:
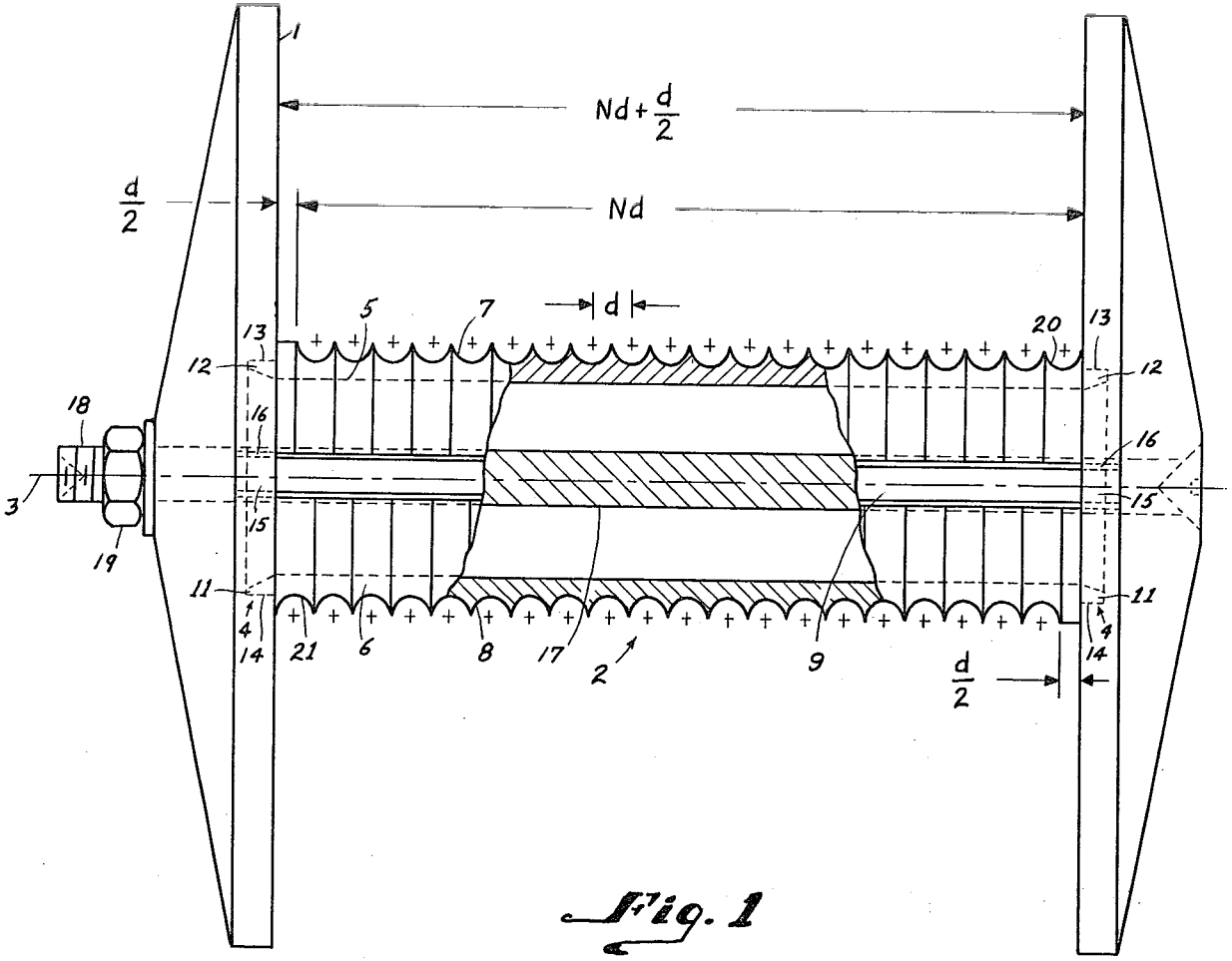
FIG. 1 is an elevational view partially in cross-section of a collapsible mandrel in accordance with the principles of the present invention.
Figure 3:
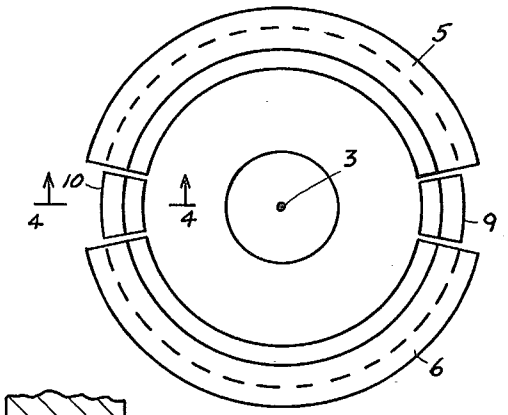
FIG. 3 is an end view of the mandrel core taken along line 3—3 of FIG. 2.
Figure 4:
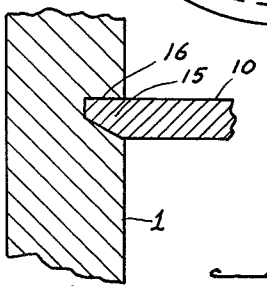
FIG. 4 is a cross sectional view of the transition member taken along line 4—4 of FIG. 3.

Referring to FIGS. 1-4, the collapsible mandrel in accordance with the principles of the present invention includes a pair of spaced parallel flanges 1 and a mandrel core 2 disposed between flanges 1 perpendicular thereto, coaxial of a longtitudinal axis 3 and removably secured to flanges 1 by a dovetail 4 at both ends of core 2.

Core 2 includes a pair of hollow partially semicircular members 5 and 6, both of which extend between flanges 1 and having a given arc length less than 180°. Each of the hollow members 5 and 6 are disposed on a different side of axis 3 and each have an outer surface containing thereof a plurality of spaced grooves 7 and 8 running substantially parallel to flanges 1 with each of the grooves 7 and 8 having a radius substantially equal to the radius of the material having a circular cross-section from which the coil is to be wound. Interposed between adjacent ends of hollow members 5 and 6 are disposed transition members 9 and 10, which are grooveless and have an outer diameter equal to the diameter of the members 5 and 6 at the deepest point of grooves 7 and 8 and an inner diameter equal to the inner diameter of members 5 and 6. Members 9 and 10 are disposed on different sides of the axis 3 and extend between flanges 1. Each of the members 9 and 10 have a selected arc length equal to the difference between 180° and the given arc length of the hollow members 5 and 6.

It has been found that a precision-wound coil can be produced successfully when the arc length of members 5 and 6 is between 160° to 170° long and when the selected arc length of members 9 and 10 is between 10° to 20°. Preferably the arc length of members 5 and 6 is 170° and the selected arc length of members 9 and 10 is 10°.

The dovetails 4 employed to removably secure core 2 to both of the flanges 1 includes a flaring tenion 11 on both ends of member 6 and a flaring tenion 12 on both ends of member 5, which conform to the arc and arc lengths of their associated members. Tenions 11 and 12 fit into mortises 13 and 14 in the form of a partially semicircular groove corresponding to the arc configuration and arc length of members 5 and 6, respectively. The members 9 and 10 are likewise removably secured to flanges 1 by a dovetail which includes a tenion 15 formed on both ends of members 9 and 10, which fits into a mortise 16 in the form of a groove in flanges 1 having an arc configuration and arc length of members 9 and 10.

Flanges 1 and core 2 are held in their position illustrated in FIG. 1 to enable winding of a single or multilayer coil on core 2 by a shaft 17 which is disposed coaxial of axis 3 between flanges 1 with the right-hand end of shaft 17 being embedded in the right-hand flange 1 and extending through the left-hand flange 1 as viewed in the drawing. The left-hand end of shaft 17 is threaded at 18 to receive a locking nut 19 which releasably locks core 2 to the pair of flanges 1 in an integral unit to enable the winding of a single or multilayer coil.

After the coil is formed, nut 19 is removed from threaded end 18 of shaft 17 to enable the separation of flanges 1 from core 2. Subsequent to this operation, members 9 and 10 are removed from their position relative to members 5 and 6 so that these members can be moved inwardly toward axis 3 and then pulled out from the formed coil, thereby providing the collapsible feature of the mandrel in accordance with the principles of the present invention.

The spacing between flanges 1 and their perpendicularity to core 2, the spacing of adjacent grooves 7 and 8, the amount of displacement between grooves 7 and 8, the transition members 9 and 10 arc lengths, and the distance of the "start" groove, such as groove 20, and the distance of the "end" groove, such as groove 21, from their associated flanges 1 must be precisely machined and maintained to a high level of tolerance in order to effectively manufacture a precision-wound coil. The spacing between the pair of flanges 1 must be maintained at $Nd+d/2$, where N is the number of turns in the coil and, thus, the number of grooves 7 and 8 and d is the diameter of the material being wound into a coil. As can be seen in FIG. 1, the spacing between adjacent ones of the grooves 7 and 8 is equal to the diameter of the material being formed into a coil and the shift of grooves 7 and 8 with respect to each other is equal to one half the diameter (d/2) of the material being formed into a coil.

Figure 2:
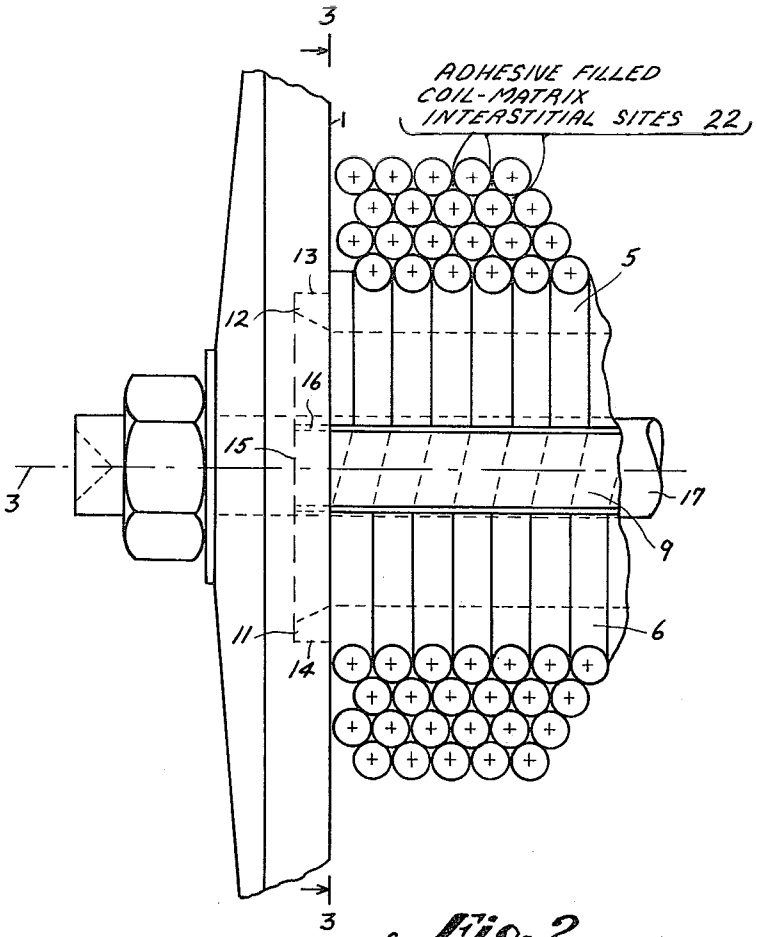
FIG. 2 is an enlarged elevational view of the left-hand end of the mandrel of FIG. 1, illustrating how a multilayer coil is wound on the mandrel in accordance with the principles of the present invention.

The collapsible mandrel in accordance with the principles of the present invention allows a precise control of the material position and spacing as the material is wound on mandrel core 2. The material is held perpendicular to axis 3, which is the axis of rotation of the mandrel, and passes through two discrete arc lengths provided by members 5 and 6. The material being wound is allowed to advance half a cable diameter for every given arc length of the mandrel rotation provided by members 5 and 6, which in the preferred embodiment is 170° of arc length. The material pitch advance occurs during the smooth transition zone provided by members 9 and 10 which have a selected arc length, which in the preferred embodiment is 10°. This advance occurs twice for each 360° rotation of the mandrel. When the material being wound approaches the mandrel flanges 1, it is constrained between the previous coil layer and flange 1 when a multilayer coil is being wound, as is best illustrated in FIG. 2. Because the material being wound is exactly positioned one half of its diameter from flange 1 along the axis 3, this material moves outward from core 2 and starts the second layer of a multiple layer precision-wound coil. By use of a suitable adhesive during the winding process of a multiple layer coil to fill all the coil-matrix interstitial sites 22, a free-standing coil can be manufactured. Upon cure of the adhesive, flanges 1 and core 2 can be collapsed away from the cable-adhesive matrix as described hereinabove resulting in a precision-wound, free standing coil. Two examples of adhesives that have been employed during the manufacture of coils employing the mandrel in accordance with the principles of the present invention are SILGARD 184, available from Dow Corning, and an epoxy resin known as TRANSFLEXGEL, obtainable from Isochem.

The dimensions mentioned hereinabove and illustrated in FIG. 1, which are related to the diameter of the material being wound to provide the coil, is the true diameter of this material with a factor added thereto to account for the diameter fluctuations of the material with this fluctuation parameter being determined for each of the different types of materials that may be employed to provide coils employing the mandrel in accordance with the principles of the present invention.

While we have described above the principles of our invention in connection with specific apparatus it is to be clearly understood that this description is made only by way of example and not as a limitation to the scope of our invention as set forth in the objects thereof and in the accompanying claims.

We claim:

1. A collapsible mandrel for precise winding of a material having a circular cross-section into a precision-wound coil comprising:

a pair of spaced parallel flanges;

a core upon which said coil is wound disposed between said pair of flanges perpendicular thereto, coaxial of a longitudinal axis and removably secured to said pair of flanges, said core including a pair of hollow, partially semicircular members extending between said pair of flanges, each of said hollow members having a given arc length less than 180°, being disposed on a different side of said axis and having an outer surface containing therein a plurality of spaced grooves substantially parallel to said pair of flanges, each of said plurality of grooves having a radius substantially equal to the radius of said material, and a pair of grooveless transition members extending between said pair of flanges, each of said transition members being disposed on a different side of said axis between adjacent ends of said pair of hollow members and having a selected arc length equal to the difference between 180° and said given arc length;

a shaft disposed coaxial of said axis extending between said pair of flanges internally of said core, said shaft having a thread on one end thereof extending beyond one of said pair of flanges to receive a nut to releasably lock said core and said pair of flanges into a integral unit when said coil is being wound and to enable removal of said nut, said pair of flanges and said pair of transition members to permit removal of said pair of hollow members after said coil has been wound.

2. A mandrel according to claim 1, wherein each end of said pair of hollow members and each end of said pair of transition members are removably secured to an associated one of said pair of flanges by a dovetail.

3. A mandrel according to claim 2, wherein said given arc length is from 160° to 170°, and said selected arc length is from 10° to 20°.

4. A mandrel according to claim 2, wherein said given arc length is in the order of 170°, and said selected arc length is in the order of 10°.

5. A mandrel according to claim 4, wherein the centers of adjacent grooves of each of said plurality of grooves are spaced from each other by an amount equal to the diameter of said material.

6. A mandrel according to claim 5, wherein said plurality of grooves of one of said pair of hollow members is shifted axially with respect to said plurality of grooves of the other of said pair of hollow members by an amount equal to one half of the diameter of said material.

7. A mandrel according to claim 6, wherein due to said axial shift said material moves outward from said core after a first layer of said coil is wound to start a second layer of a multiple layer precision-wound coil.

8. A mandrel according to claim 7, wherein a first turn of said second layer and other even numbered layers is constrained between the adjacent one of said pair of flanges and the last turn of said first layer and other odd numbered layers.

9. A mandrel according to claim 8, wherein interstitial sites of said multiple layer coil are filled with an adhesive during the winding of said coil to provide a free-standing coil after said adhesive is cured and said mandrel is collapsed and removed.

10. A mandrel according to claim 1, wherein said given arc length is from 160° to 170°, and said selected arc length is from 10° to 20°.

11. A mandrel according to claim 1, wherein said given arc length is in the order of 170°, and said selected arc length is in the order of 10°.

12. A mandrel according to claim 11, wherein the centers of adjacent grooves of each of said plurality of grooves are spaced from each other by an amount equal to the diameter of said material.

13. A mandrel according to claim 10, wherein said plurality of grooves of one of said pair of hollow members is shifted axially with respect to said plurality of grooves of the other of said pair of hollow members by an amount equal to one half of the diameter of said material.

14. A mandrel according to claim 13, wherein due to said axial shift said material moves outward from said core after a first layer of said coil is wound to start a second layer of a multiple layer precision-wound coil.

15. A mandrel according to claim 14, wherein a first turn of said second layer and other even numbered layers is constrained between the adjacent one of said pair of flanges and the last turn of said first layer and other odd numbered layers.

16. A mandrel according to claim 15, wherein interstitial sites of said multiple layer coil are filled with an adhesive during the winding of said coil to provide a free-standing coil after said adhesive cured and said mandrel is collapsed and removed.

17. A mandrel according to claim 1, wherein the center of adjacent grooves of each of said plurality of grooves are spaced from each other by an amount equal to the diameter of said material.

18. A mandrel according to claim 17, wherein said plurality of grooves of one of said pair of hollow members is shifted axially with respect to said plurality of grooves of the other of said pair of hollow members by an amount equal to one half of the diameter of said material.

19. A mandrel according to claim 18, wherein due to said axial shift said material moves outward from said core after a first layer of said coil is wound to start a second layer of a multiple layer precision-wound coil.

20. A mandrel according to claim 19, wherein a first turn of said second layer and other even numbered layers is constrained between the adjacent one of said pair of flanges and the last turn of said first layer and other odd numbered layers.

21. A mandrel according to claim 20, wherein interstitial sites of said multiple layer coil are filled with an adhesive during the winding of said coil to provide a free-standing coil after said adhesive is cured and said mandrel is collapsed and removed.

22. A mandrel according to claim 1, wherein said plurality of grooves of one of said pair of hollow members is shifted axially with respect to said plurality of grooves of the other of said pair of hollow members by an amount equal to one half of the diameter of said material.

23. A mandrel according to claim 22, wherein due to said axial shift said material moves outward from said core after a first layer of said coil is wound to start a second layer of a multiple layer precision-wound coil.

24. A mandrel according to claim 23, wherein a first turn of said second layer and other even numbered layers is constrained between the adjacent one of said pair of flanges and the last turn of said first layer and other odd numbered layers.

25. A mandrel according to claim 24, wherein interstitial sites of said multiple layer coil are filled with an adhesive during the winding of said coil to provide a free-standing coil after said adhesive is cured and said mandrel is collapsed and removed.

26. A mandrel according to claim 1, wherein said plurality of grooves of one of said pair of hollow members is oriented with respect to said plurality of grooves of said other of said pair of hollow members such that said material moves outward from said core after a first layer of said coil is wound to start a second layer of a multiple precision-wound coil.

27. A mandrel according to claim 26, wherein a first turn of said second layer and other even numbered layers is constrained between the adjacent one of said pair of flanges and the last turn of said first layer and other odd numbered layers.

28. A mandrel according to claim 27, wherein interstitial sites of said multiple layer coil are filled with an adhesive during the winding of said coil to provide a free-standing coil after said adhesive is cured and said mandrel is collapsed and removed.

29. A mandrel according to claim 1, wherein said plurality of grooves of one of said pair of hollow members and said plurality of grooves of the other of said pair of hollow members are oriented with respect to each other and said pair of flanges to provide a multiple layer precision-wound coil.

30. A mandrel according to claim 29, wherein interstitial sites of said multiple layer coil are filled with an adhesive during the winding of said coil to provide a free-standing coil after said adhesive is cured and said mandrel is collapsed and removed.

* * * * *